US011047385B2

(12) United States Patent
Maeda et al.

(10) Patent No.: US 11,047,385 B2
(45) Date of Patent: Jun. 29, 2021

(54) ELECTRIC COMPRESSOR HAVING COMPRESSION PORTION AND MOTOR CHAMBER COMMUNICATION VIA PASSAGE IN FLANGE OF SHAFT SUPPORT MEMBER

(71) Applicant: KABUSHIKI KAISHA TOYOTA JIDOSHOKKI, Kariya (JP)

(72) Inventors: Takumi Maeda, Aichi-ken (JP); Takuro Yamashita, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 202 days.

(21) Appl. No.: 16/364,526

(22) Filed: Mar. 26, 2019

(65) Prior Publication Data

US 2019/0301459 A1 Oct. 3, 2019

(30) Foreign Application Priority Data

Mar. 30, 2018 (JP) ..... JP2018-070075

(51) Int. Cl.
*F04C 18/02* (2006.01)
*F04C 29/12* (2006.01)
(Continued)

(52) U.S. Cl.
CPC ..... *F04C 18/0215* (2013.01); *F04C 29/12* (2013.01); *F04C 23/008* (2013.01);
(Continued)

(58) Field of Classification Search
CPC .. F04C 18/0215; F04C 29/0085; F04C 29/06; F04C 23/008; F04C 23/02; F04C 29/00;
(Continued)

(56) References Cited

U.S. PATENT DOCUMENTS 5,599,178 A 2/1997 Yuzaki et al.
6,872,063 B2 3/2005 Kimura et al.
(Continued)

FOREIGN PATENT DOCUMENTS

EP 3093493 A1 11/2016
JP 8-74753 A 3/1996
(Continued)

OTHER PUBLICATIONS

Communication dated May 14, 2020, from the Korean Intellectual Property Office in Application No. 10-2019-0035012.

*Primary Examiner* — Mary Davis
*Assistant Examiner* — Paul W Thiede
(74) *Attorney, Agent, or Firm* — Sughrue Mion, PLLC

(57) ABSTRACT

An electric compressor includes a housing including a motor housing, a compressor housing, and a shaft support member, which are fastened with a fastening member, and a fluid passage. The shaft support member has a fitted surface fitted onto an opening of the motor housing and a flange portion extending from the fitted surface and interposed between a first end face of the motor housing and a second end face of the compressor housing. The flange portion has a through hole through which the fastening member is inserted and a passage-forming hole through which a first recessed portion and a second recessed portion are in communication with each other. The through hole and the passage-forming hole are arranged in a circumferential direction of the flange portion. The fluid passage is formed at least by the first recessed portion, the second recessed portion, and the passage-forming hole.

3 Claims, 3 Drawing Sheets

(51) Int. Cl.
*F04C 23/00* (2006.01)
*F04C 29/00* (2006.01)
*F04C 29/04* (2006.01)

(52) U.S. Cl.
CPC ..... *F04C 29/00* (2013.01); *F04C 29/045* (2013.01); *F04C 2240/30* (2013.01); *F04C 2240/40* (2013.01)

(58) Field of Classification Search
CPC .... F04C 29/12; F04C 29/045; F04C 2240/30; F04C 2240/605; F04C 2240/40; F01C 21/10
See application file for complete search history.

(56) References Cited

U.S. PATENT DOCUMENTS

| | | | | |
|---|---|---|---|---|
| 7,338,265 | B2 * | 3/2008 | Grassbaugh | F04C 28/265 418/55.4 |
| 2012/0237374 | A1 | 9/2012 | Ochiai | |
| 2013/0142682 | A1 * | 6/2013 | Watanabe | F04D 25/0606 417/423.7 |

FOREIGN PATENT DOCUMENTS

| | | | |
|---|---|---|---|
| JP | 2004-144045 | A | 5/2004 |
| JP | 2011-089507 | A | 5/2011 |
| JP | 2015-83780 | A | 4/2015 |

* cited by examiner

ELECTRIC COMPRESSOR HAVING COMPRESSION PORTION AND MOTOR CHAMBER COMMUNICATION VIA PASSAGE IN FLANGE OF SHAFT SUPPORT MEMBER

CROSS-REFERENCE TO RELATED APPLICATION

This application claims priority to Japanese Patent Application No. 2018-070075 filed on Mar. 30, 2018, the entire disclosure of which is incorporated herein by reference.

BACKGROUND ART

The present disclosure relates to an electric compressor including a motor housing, a compressor housing, and a shaft support member.

An electric compressor in which a movable scroll is driven by an electric motor commonly includes a bottomed cylindrical motor housing, a bottomed cylindrical compressor housing, and a shaft support member. The motor housing accommodates the electric motor. The compressor housing accommodates a compression portion including a fixed scroll and a movable scroll. The shaft support member supports a rotary shaft, and includes a flange portion disposed in an outer peripheral portion of the shaft support member (see, for example, Japanese Patent Application Publication No. 2011-89507).

In Japanese Patent Application Publication No. 2011-89507, the proximal portion of a flange portion that is disposed at one end of a shaft support member in the thickness direction of the shaft support member is fitted onto an inner peripheral surface of a first housing (motor housing). The flange portion of the shaft support member is interposed between and tightly held by an end face of an open end of the first housing and an end face of an open end of a second housing. In the shaft support member according to Japanese Patent Application Publication No. 2011-89507, a plurality of suction passages extends in an axial direction and a radial direction of a rotary shaft, and is formed radially outward of a bearing holding portion. Then, a refrigerant gas is introduced from a suction port into a compression portion through a gap formed in an electric motor and the suction passages of the shaft support member.

In the shaft support member according to Japanese Patent Application Publication No. 2011-89507, the suction passages communicating with the compression portion are formed inward of a fitted surface of the shaft support member that is fitted onto the motor housing. This configuration decreases rigidity of the shaft support member, thereby making it difficult to suppress vibration of the compression portion and the rotary shaft and occurrence of noise. However, if the suction passages are formed outward of the fitted surface, the housing including the shaft support member is radially increased.

The present disclosure, which has been made in light of the above-described problem, is directed to providing an electric compressor that is excellent in quietness while suppressing an increase in a radial direction of a housing.

SUMMARY

In accordance with an aspect of the present invention, there is provided an electric compressor that includes a housing including a motor housing, a compressor housing, and a shaft support member, a rotary shaft, an electric motor, a compression portion, and a fluid passage. The rotary shaft is accommodated in the housing. The electric motor is accommodated in the housing and configured to rotate the rotary shaft. The compression portion is accommodated in the housing and configured to be driven by rotation of the rotary shaft to compress a fluid. The motor housing has a bottomed cylindrical shape and accommodates the electric motor. The compressor housing has a bottomed cylindrical shape and accommodates the compression portion. The shaft support member is interposed between and held by a first end face of an open end of the motor housing and a second end face of an open end of the compressor housing. The shaft support member cooperates with the motor housing to form a motor chamber that accommodates the electric motor, and cooperates with the compressor housing to form a compression chamber that accommodates the compression portion. The shaft support member has an insertion hole through which the rotary shaft is inserted, and rotatably supports the rotary shaft. The shaft support member, the motor housing, and the compressor housing are fastened with a fastening member to form the housing. The motor chamber is in communication with the compression portion through the fluid passage. The first end face has a first fastening hole into which the fastening member is inserted and a first recessed portion formed in communication with the motor chamber. The second end face has a second fastening hole into which the fastening member is inserted and a second recessed portion formed in communication with the compression chamber. The shaft support member has a fitted surface fitted onto an opening of the motor housing and a flange portion extending from the fitted surface and interposed between and held by the first end face and the second end face. The flange portion has a through hole through which the fastening member is inserted and a passage-forming hole through which the first recessed portion and the second recessed portion are in communication with each other. The through hole and the passage-forming hole are arranged in a circumferential direction of the flange portion. The fluid passage is formed at least by the first recessed portion, the second recessed portion, and the passage-forming hole.

BRIEF DESCRIPTION OF THE DRAWINGS

The disclosure together with objects and advantages thereof, may best be understood by reference to the following description of the embodiment together with the accompanying drawings in which.

DETAILED DESCRIPTION OF THE EMBODIMENTS

An embodiment of the present disclosure in which an electric compressor is embodied as a scroll type compressor will be described below with reference to FIGS. 1 to 4.

Figure 1:
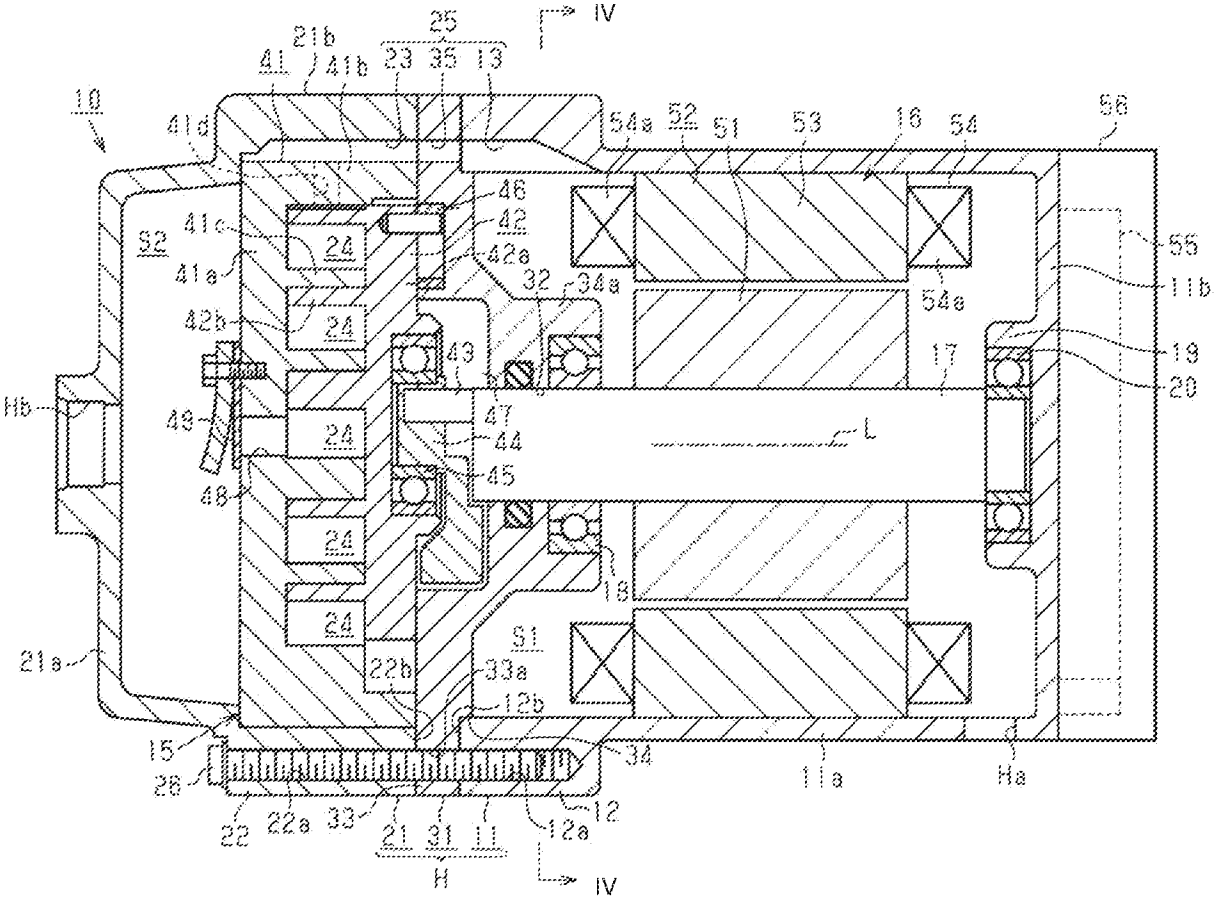
FIG. 1 is a cross-sectional view of a scroll type compressor according to an embodiment.

As illustrated in FIG. 1, an electric compressor, which is in this embodiment, is a scroll type compressor 10, includes a housing H in which an inlet Ha and an outlet Hb are formed. A fluid (refrigerant gas in the present embodiment) is introduced from the inlet Ha and is discharged from the outlet Hb. The housing H has a substantially cylindrical shape as a whole. The scroll type compressor 10 includes, more specifically, the housing H includes a motor housing 11 having a bottomed cylindrical shape, a compressor housing 21 having a bottomed cylindrical shape, and a shaft support member 31 having a disc shape and disposed between the motor housing 11 and the compressor housing 21. The motor housing 11, the compressor housing 21, and the shaft support member 31 are assembled such that an end face of an open end of the motor housing 11 and an end face of an open end of the compressor housing 21, which are explained later, are in contact with the shaft support member 31.

The inside of the housing H is separated into a motor chamber S1 and a compression chamber S2 by the shaft support member 31. The shaft support member 31 cooperates with the motor housing 11 to form the motor chamber S1, and an electric motor 16 is accommodated in the motor chamber S1. The shaft support member 31 cooperates with the compressor housing 21 to form the compression chamber S2, and a compression portion 15 is accommodated in the compression chamber S2.

The inlet Ha is formed in a side wall portion 11*a* of the motor housing 11, specifically, at a position in the side wall portion 11*a* adjacent to a bottom portion 11*b* of the motor housing 11, and is in communication with the motor chamber S1. The outlet Hb is formed in a bottom portion 21*a* of the compressor housing 21. The compression portion 15 accommodated in the compression chamber S2 introduces and compresses the fluid, which has been introduced into the motor chamber S1 from the inlet Ha, and then discharges the fluid from the outlet Hb. The electric motor 16 accommodated in the motor chamber S1 configured to drive the compression portion 15. A rotary shaft 17, the compression portion 15, and the electric motor 16 are accommodated in the housing H. That is, the compression portion 15 is accommodated in the housing H, and is configured to be driven by rotation of the rotary shaft 17 to compress the fluid. The electric motor 16 is disposed adjacent to the inlet Ha in the housing H, and the compression portion 15 is disposed adjacent to the outlet Hb in the housing H.

The rotary shaft 17 is rotatably accommodated in the housing H. The shaft support member 31 rotatably supporting a part of the rotary shaft 17 is interposed between the compression portion 15 and the electric motor 16. The shaft support member 31 has therethrough an insertion hole 32 through which the rotary shaft 17 is inserted, and a first bearing 18 is disposed in the insertion hole 32. The shaft support member 31 and the bottom portion 11*b* of the motor housing 11 face each other in an axial direction of the rotary shaft 17, and a cylindrical boss 19 protrudes from the bottom portion 11*b* of the motor housing 11 toward the motor chamber S1. A second bearing 20 is disposed inside the boss 19. The rotary shaft 17 is rotatably supported by both the bearings 18, 20.

In the housing H, a fluid passage, which, in this embodiment, is a suction passage 25 is formed for directing the fluid, which has been introduced into the motor chamber S1 from the inlet Ha, from the motor chamber S1 to the compression portion 15. In other words, the motor chamber S1 is in communication with the compression portion 15 through the suction passage 25. The compression portion 15 is configured to compress the fluid introduced into the compression portion 15 through the suction passage 25, and includes a fixed scroll 41 fixed to the housing H and a movable scroll 42 configured to revolve, specifically, configured to make an orbital motion, with respect to the fixed scroll 41.

The fixed scroll 41 is fixed to an inner peripheral surface of a peripheral wall portion 21*b* of the compressor housing 21. The fixed scroll 41 includes a base plate 41*a* having a disc shape and disposed coaxially with the rotary shaft 17, an outer wall portion 41*b* extending from the base plate 41*a* along the inner peripheral surface of the peripheral wall portion 21*b*, and a scroll wall 41*c* extending from the base plate 41*a* and disposed inward of the outer wall portion 41*b* in a radial direction of the fixed scroll 41. The outer wall portion 41*b* surrounds the scroll wall 41*c*. A suction hole 41*d* for introducing the fluid into the inside of the outer wall portion 41*b* is formed through the outer wall portion 41*b* in a thickness direction of the outer wall portion 41*b*.

The movable scroll 42 includes a base plate 42*a* having a disc shape and facing the base plate 41*a* and a scroll wall 42*b* extending from the base plate 42*a* toward the base plate 41*a*. The fixed scroll 41 and the movable scroll 42 are meshed with each other. Specifically, the scroll wall 41*c* and the scroll wall 42*b* are meshed with each other on the radially inner side with respect to the outer wall portion 41*b*, a top end face of the scroll wall 41*c* is in contact with the base plate 42*a*, and a top end face of the scroll wall 42*b* is in contact with the base plate 41*a*, A fluid compression chamber 24 in which the fluid is compressed is defined by the fixed scroll 41 and the movable scroll 42.

The insertion hole 32 of the shaft support member 31 is closed by the base plate 42*a* of the movable scroll 42, so that a back pressure chamber 47 is defined by a wall of the insertion hole 32 and the movable scroll 42. The fluid compressed in the fluid compression chamber 24 is introduced into the back pressure chamber 47. This causes the pressure in the back pressure chamber 47 to become higher than the suction pressure, and urges the movable scroll 42 against the fixed scroll 41. This configuration enhances the sealing of the fluid compression chamber 24 by resisting compression reaction force that occurs along the axial direction of the rotary shaft 17 and acts on the movable scroll 42 while the compression portion 15 is driven.

The movable scroll 42 is configured to make an orbital motion in conjunction with rotation of the rotary shaft 17. Specifically, a part of the rotary shaft 17 protrudes toward the compression portion 15 through the insertion hole 32 of the shaft support member 31. An eccentric pin 43 is disposed at a position that is eccentric with respect to an axis L of the rotary shaft 17 on an end face of the rotary shaft 17 adjacent to the compression portion 15. A bushing 44 is disposed for the eccentric pin 43. The bushing 44 and the movable scroll 42 (specifically, the base plate 42*a*) are connected via a bearing 45.

The scroll type compressor 10 includes an anti-rotation part 46 that is disposed on an outer peripheral portion of the shaft support member 31 to restrict rotation of the movable scroll 42 while allowing orbital motion of the movable scroll 42. Note that a plurality of the anti-rotation parts 46 is disposed in this embodiment. As the rotary shaft 17 rotates in a predetermined forward direction, the movable scroll 42 makes an orbital motion in the forward direction. The movable scroll 42 makes an orbital motion in the forward direction about an axis of the fixed scroll 41 (that is, the axis L of the rotary shaft 17).

This reduces the volume of the fluid compression chamber 24, so that the fluid introduced into the motor chamber S1 from the inlet Ha flows through a gap formed in the electric motor 16 and reaches the suction passage 25. After the fluid flows into the compression chamber S2 through the suction passage 25, the fluid is introduced into the fluid compression chamber 24 through the suction hole 41*d*, which is formed through the outer wall portion 41*b* of the fixed scroll 41, and is compressed in the fluid compression chamber 24. The compressed fluid is discharged from a discharge port 48 formed through the base plate 41*a*, and thereafter is discharged from the outlet Hb. A discharge valve 49 configured to cover the discharge port 48 is disposed on the base plate 41*a*. The fluid compressed in the fluid compression chamber 24 pushes out the discharge valve 49 and is discharged from the discharge port 48.

The electric motor 16 rotates the rotary shaft 17 to revolve the movable scroll 42. The electric motor 16 includes a rotor 51 rotating integrally with the rotary shaft 17 and a stator 52 surrounding the rotor 51. The rotor 51 is connected to the rotary shaft 17. The rotor 51 includes a permanent magnet (not illustrated). The stator 52 is fixed to an inner peripheral surface of the side wall portion 11*a* of the housing H (specifically, the motor housing 11). The stator 52 includes a stator core 53 facing the cylindrical rotor 51 in a radial direction of the rotor 51 and a coil 54 that is wound in the stator core 53. The coil 54 includes coil ends 54*a* protruding from opposite end faces of the stator core 53 in an axial direction of the stator core 53. In other words, the electric motor 16 includes a pair of coil ends 54*a*, and the coil ends 54*a* are respectively disposed on opposite sides of the electric motor 16 in the axial direction of the rotary shaft 17.

The scroll type compressor 10 includes an inverter 55 serving as a drive circuit configured to drive the electric motor 16. The inverter 55 is accommodated in the housing H, specifically, accommodated in a cylindrical cover member 56 that is attached to the bottom portion 11*b* of the motor housing 11. The inverter 55 and the coil 54 are electrically connected.

Next, the motor housing 11, the compressor housing 21, and the shaft support member 31 will be described in detail.

Figure 2:
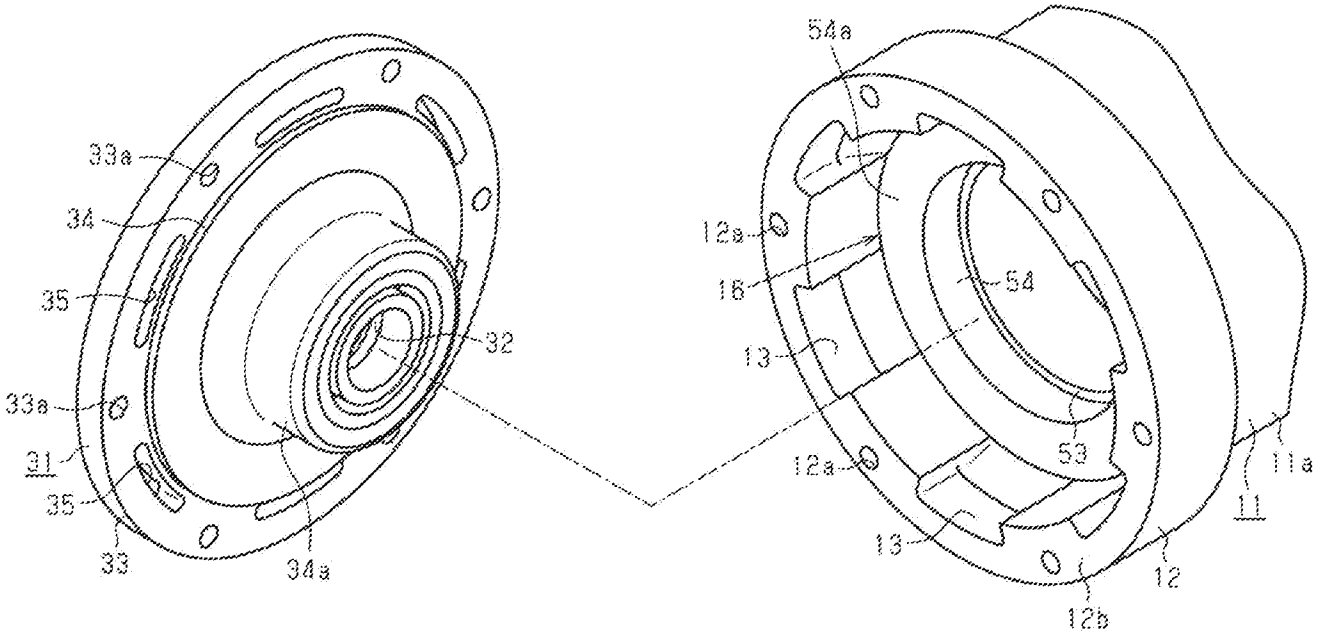
FIG. 2 is an exploded perspective view of a shaft support member, a motor housing, and an electric motor.

As illustrated in FIGS. 1 and 2, a first flange 12 is disposed at the open end of the motor housing 11. The first flange 12 protrudes outward from the open end of the motor housing 11 in a radial direction of the motor housing 11 and over entirety in a circumferential direction of the motor housing 11. The first flange 12 of the motor housing 11, which is disposed at the open end of the motor housing 11, has a first end face 12*b* that is disposed in contact with the shaft support member 31. The first end face 12*b* of the motor housing 11 has a plurality of first fastening holes, which, in this embodiment, is a plurality of first female threaded portions 12*a*, such that the first female threaded portions 12*a* are recessed in the axial direction of the rotary shaft 17. The first female threaded portions 12*a* are spaced from each other at equal distances in the circumferential direction of the motor housing 11.

The first end face 12*b* of the motor housing 11 has a plurality of first recessed portions 13. The first recessed portions 13 are recessed in an inner peripheral surface of the first flange 12 toward an outer peripheral surface of the first flange 12 in a radial direction of the first flange 12, and are formed in communication with the motor chamber S1. The first recessed portion 13 allows the first end face 12*b* to communicate with the inside of the motor housing 11, i.e., the motor chamber S1. The first recessed portions 13 are spaced from each other at equal distances in the circumferential direction of the motor housing 11. The first female threaded portions 12*a* and the first recessed portions 13 are alternately disposed in the circumferential direction of the motor housing 11.

At least a part of the first recessed portion 13 faces, in a radial direction of the rotary shaft 17, an outer peripheral surface of one coil end 54*a* of the coil ends 54*a* of the electric motor 16 that is closer to the shaft support member 31 than the other coil end 54*a*. Since the plurality of first recessed portions 13 is disposed in the circumferential direction of the motor housing 11, the plurality of first recessed portions 13 faces the outer peripheral surface of the one coil end 54*a* at a plurality of positions.

Figure 3:
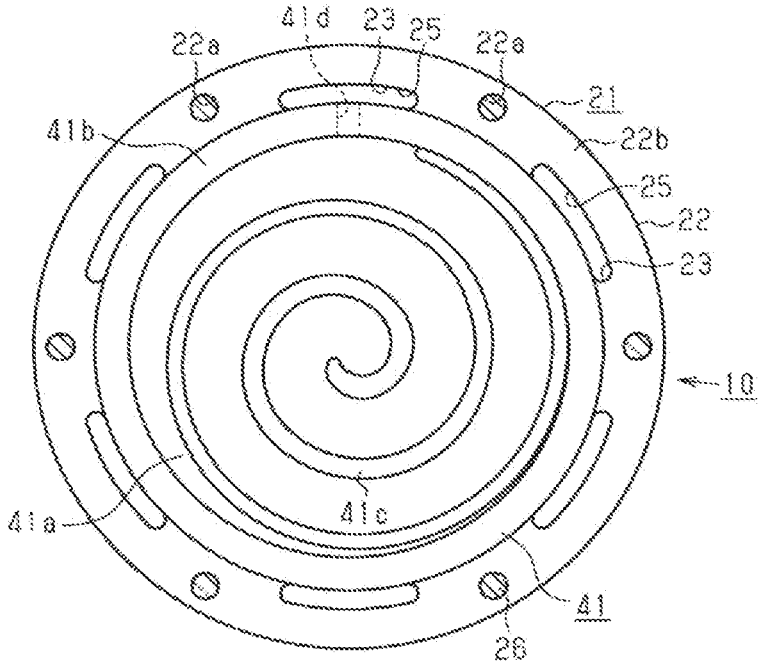
FIG. 3 is a view of the inside of the scroll type compressor viewed from a fixed scroll side.

As illustrated in FIGS. 1 and 3, a second flange 22 is disposed at the open end of the compressor housing 21. The second flange 22 protrudes outward from the open end of the compressor housing 21 in a radial direction of the compressor housing 21 and over entirety in a circumferential direction of the compressor housing 21. The second flange 22 of the compressor housing 21, which is disposed at the open end of the compressor housing 21, has a second end face 22*b* that is disposed in contact with the shaft support member 31. The second end face 22*b* of the compressor housing 21 has a plurality of second fastening holes, which, in this embodiment, is a plurality of second female threaded portions 22*a*. The second female threaded portions 22*a* are recessed in the axial direction of the rotary shaft 17, specifically, are formed through the second flange 22 in a thickness direction of the second flange 22. The second female threaded portions 22*a* are spaced from each other at equal distances in the circumferential direction of the compressor housing 21.

The second end face 22*b* of the compressor housing 21 has a plurality of second recessed portions 23. The second recessed portions 23 are recessed in an inner peripheral surface of the second flange 22 toward an outer peripheral surface of the second flange 22 in a radial direction of the second flange 22, and are formed in communication with the compression chamber 52. The second recessed portion 23 allows the second end face 22*b* to communicate with the inside of the compressor housing 21, i.e., the compression chamber S2. The second recessed portions 23 are spaced from each other at equal distances in the circumferential direction of the compressor housing 21. The second female threaded portions 22*a* and the second recessed portions 23 are alternately disposed in the circumferential direction of the compressor housing 21.

As illustrated in FIGS. 1 and 2, an insertion hole 32 is formed through the shaft support member 31 in a thickness direction of the shaft support member 31 at a radial center portion of the shaft support member 31. A flange portion 33 is disposed on an outer peripheral portion of the shaft support member 31. The shaft support member 31 includes a fitted portion 34 whose outer peripheral surface is fitted onto the inner peripheral surface of the first flange 12 of the motor housing 11. In other words, the shaft support member 31 has a fitted surface, which in this embodiment, is the outer peripheral surface of the fitted portion 34 that is fitted onto an opening of the motor housing 11. The fitted portion 34 has a cylindrical shape, and the insertion hole 32 is formed through a center portion of the fitted portion 34. The fitted portion 34 includes a small-diameter portion 34*a* adjacent to the electric motor 16, and the first bearing 18 is disposed in and supported by the small-diameter portion 34*a*. Since the outer peripheral surface of the fitted portion 34 serving as a fitted surface is fitted onto the opening of the motor housing 11, the axis L of the rotary shaft 17 supported by the shaft support member 31 is easily matched with a center axis of the motor housing 11. The flange portion 33 extends from the outer peripheral surface of the fitted portion 34.

A plurality of through holes 33*a* is formed through the flange portion 33 of the shaft support member 31 in a thickness direction of the flange portion 33, and the through holes 33*a* are spaced from each other at equal distances in a circumferential direction of the flange portion 33. A plurality of passage-forming holes 35 is formed through the flange portion 33 in the thickness direction of the flange portion 33. The passage-forming holes 35 are spaced from each other at equal distances in the circumferential direction of the flange portion 33. Each of the passage-forming holes 35 has an elongated hole shape that extends in the circumferential direction of the flange portion 33. Specifically, the passage-forming hole 35 extends in an arc shape along the circumferential direction of the flange portion 33. The flange portion 33 has the through holes 33*a* and the passage-forming holes 35 that are arranged alternately in the circumferential direction of the flange portion 33. The through holes 33*a* and the passage-forming holes 35 are formed outward of the outer peripheral surface (fitted surface) of the fitted portion 34.

As illustrated in FIG. 1, in the housing H, the first end face 12*b* of the motor housing 11 is disposed in contact with one surface of opposite surfaces of the flange portion 33 of the shaft support member 31 in the thickness direction of the flange portion 33, and the second end face 22*b* of the compressor housing 21 is disposed in contact with the other surface of the flange portion 33 in the thickness direction of the flange portion 33.

Each of the first female threaded portions 12*a* of the first flange 12 is in communication with the corresponding second female threaded portion 22*a* of the second flange 22 through the through hole 33*a* of the flange portion 33. The first flange 12, the flange portion 33, and the second flange 22 are fastened with fastening members, which, in this embodiment, are bolts 26, to form the housing H. Each of the bolts 26 is inserted into the first female threaded portion 12*a* of the first flange 12, through the through hole 33*a* of the flange portion 33 and the second female threaded portion 22*a* of the second flange 22 with the flange portion 33 interposed between the first female threaded portion 12*a* and the second female threaded portion 22*a*. In the housing H, the flange portion 33 is interposed between and tightly held by the first end face 12*b* of the motor housing 11 and the second end face 22*b* of the compressor housing 21.

Figure 4:
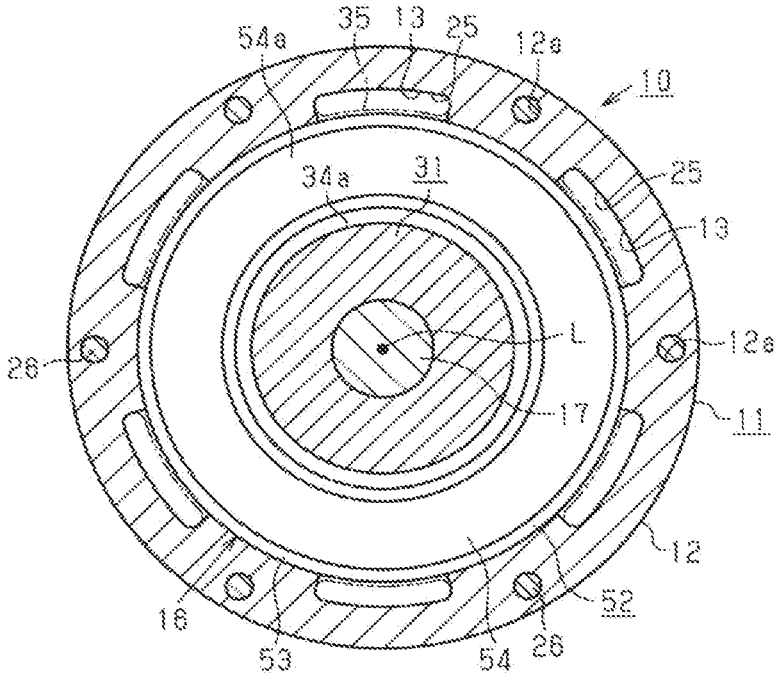
FIG. 4 is a cross-sectional view of the inside of the scroll type compressor taken along line IV-IV in FIG. 1 viewed from a motor housing side.

As illustrated in FIGS. 1 and 4, the first recessed portion 13 of the motor housing 11 and the second recessed portion 23 of the compressor housing 21 are in communication with each other through the passage-forming hole 35 of the flange portion 33. The passage-forming hole 35 faces the whole of an opening of the first recessed portion 13 formed in the first end face 12*b*, and faces the whole of an opening of the second recessed portion 23 formed in the second end face 22*b*.

A part of an inner surface of the passage-forming hole 35 adjacent to an outer peripheral surface of the flange portion 33 is continuous with a part of an inner surface of the first recessed portion 13 adjacent to the outer peripheral surface of the first flange 12 along the axial direction of the rotary shaft 17. In addition, the part of the inner surface of the passage-forming hole 35 adjacent to the outer peripheral surface of the flange portion 33 is continuous with a part of an inner surface of the second recessed portion 23 adjacent to the outer peripheral surface of the second flange 22 along the axial direction of the rotary shaft 17. Further, a part of the inner surface of the passage-forming hole 35 adjacent to the fixed scroll 41 is continuous with a part of an outer peripheral surface of the outer wall portion 41*b* along the axial direction of the rotary shaft 17.

In the housing H, the suction passage 25 serving as a fluid passage is formed at least by the first recessed portion 13, the passage-forming hole 35, and the second recessed portion 23. The suction passage 25 allows the motor chamber S1 and the suction hole 41*d* of the compression portion 15 to communicate with each other. Specifically, the suction passage 25 is a passage which directs the fluid, which will be introduced into the fluid compression chamber 24 through the suction hole 41*d*, from the motor chamber S1 to the suction hole 41*d*.

The suction passage 25 is formed outward of the back pressure chamber 47 in a radial direction of the shaft support member 31, and the passage-forming hole 35 constituting a part of the suction passage 25 is formed through the flange portion 33 of the shaft support member 31. The flange portion 33 is a section that constitutes a part of an outer peripheral surface of the housing H, and is a section that is interposed between and held by the motor housing 11 and the compressor housing 21 when the motor housing 11, the shaft support member 31, and the compressor housing 21 are fastened with the shaft support member 31 interposed between the motor housing 11 and the compressor housing 21. That is, the flange portion 33 is an existing joining surface where the motor housing 11 and the compressor housing 21 face each other via the flange portion 33. Therefore, in the shaft support member 31, the passage-forming hole 35 is not formed in the fitted portion 34 that has the insertion hole 32, but is formed outward of the outer peripheral surface (fitted surface) of the fitted portion 34 in the radial direction of the shaft support member 31.

Next, operation of the scroll type compressor 10 will be described.

When the rotary shaft 17 is rotated by power supply to the electric motor 16, the bushing 44 revolves around the rotary shaft 17 and the movable scroll 42 revolves. Then, the fluid is introduced into the housing H, specifically, introduced into the motor chamber S1 in the housing H from the inlet Ha. The fluid passes through the gap formed in the electric motor 16 while contacting the coil end 54*a* of the coil ends 54*a* that is closer to the bottom portion 11*b* of the motor housing 11 than the other coil end 54*a*, and flows in the axial direction of the rotary shaft 17.

While contacting the coil end 54*a* that is closer to the shaft support member 31 than the other coil end 54*a*, the fluid is introduced into the suction passage 25 from the first recessed portion 13, and flows through the passage-forming hole 35 and the second recessed portion 23 into the compression chamber S2 in the compressor housing 21. Then, the fluid is introduced into the compression portion 15 from the suction hole 41*d*. The fluid introduced into the fluid compression chamber 24 of the compression portion 15 is compressed by the orbital motion of the movable scroll 42, and the compressed fluid is discharged from the discharge port 48, then pushes out the discharge valve 49 and is discharged from the outlet Hb. Note that the highly-compressed fluid is introduced into the back pressure chamber 47 as a control gas, and this control gas presses the movable scroll 42 against the fixed scroll 41 in the axial direction of the rotary shaft 17.

The above embodiment of the present disclosure offers the following effects.

(1) Each of the passage-forming holes 35, which is a part of the suction passage 25, is formed in the flange portion 33 of the shaft support member 31, which the bolts 26 are inserted through to form the housing H. That is, the passage-forming hole 35 is not formed in the fitted portion 34 that has the insertion hole 32, but is formed outward of the outer peripheral surface (fitted surface) of the fitted portion 34 in the radial direction of the shaft support member 31. The passage-forming hole 35 and the through hole 33*a* are arranged in the circumferential direction of the flange portion 33. This configuration allows the suction passage 25 to pass through the existing joining surface without an increase in the diameter of the flange portion 33. This configuration does not cause a decrease in rigidity of the fitted portion 34, i.e., the shaft support member 31, thereby easily suppressing vibration of the rotary shaft 17 and obtaining excellent quietness in the scroll type compressor 10.

(2) The passage-forming hole 35 is formed through the flange portion 33, which the bolts 26 are inserted through to fasten the motor housing 11 and the compressor housing 21. More specifically, in the flange portion 33, the passage-forming hole 35 is interposed between adjacent through holes 33*a* for receiving the bolts 26 in the circumferential direction of the flange portion 33. This configuration suppresses an increase in diameter of the shaft support member 31, thereby suppressing an increase in diameter of the housing H by effectively using the flange portion 33 for coupling between the motor housing 11 and the compressor housing 21.

(3) The motor housing 11 and the compressor housing 21 are fastened with the bolts 26 that is inserted through the flange portion 33 with the flange portion 33 interposed between and held by the motor housing 11 and the compressor housing 21. The flange portion 33 is held in the thickness direction of the flange portion 33. This configuration increases support rigidity of the shaft support member 31 that supports the rotary shaft 17. Therefore, this configuration suppresses vibration of the shaft support member 31, which is caused by vibration of the rotary shaft 17, and obtains excellent quietness in the scroll type compressor 10, (4) The passage-forming hole 35 formed through the flange portion 33 of the shaft support member 31 has an elongated hole shape that extends in the circumferential direction of the flange portion 33. This configuration easily secures a flow passage cross-sectional area in a part of the suction passage 25 formed by the passage-forming hole 35 without an increase in diameter of the flange portion 33.

(5) The first recessed portion 13 is formed in the first flange 12, and the second recessed portion 23 is formed in the second flange 22. This configuration effectively uses the first flange 12 and the second flange 22, which is for coupling between the motor housing 11 and the compressor housing 21, to form the suction passage 25, and suppresses an increase in diameter of the housing H.

(6) At least a part of the first recessed portion 13 faces, in the radial direction of the rotary shaft 17, the outer peripheral surface of the one coil end 54*a* closer to the shaft support member 31 than the other coil end 54*a*. Therefore, the fluid introduced into the suction passage 25 from the motor chamber S1 is brought into contact with the coil end 54*a* closer to the shaft support member 31. In addition, the fluid introduced from the inlet Ha is brought into contact with the other coil end 54*a* closer to the bottom portion 11*b* of the motor housing 11. Accordingly, this configuration enables both the coil ends 54*a* to be cooled by the fluid.

(7) A part of the inner surface of the passage-forming hole 35 adjacent to the fixed scroll 41 is continuous with the outer peripheral surface of the outer wall portion 41*b* of the fixed scroll 41 in the axial direction of the rotary shaft 17. This prevents the outer wall portion 41*b* from closing a part of the passage-forming hole 35, thereby suppressing a decrease in the flow passage cross-sectional area of the suction passage 25.

Note that the above embodiment may be modified as follows.

Each of the passage-forming holes 35 may not have an elongated hole shape that extends in the circumferential direction of the flange portion 33. For example, the passage-forming hole 35 may have a round hole shape or an elliptical hole shape.

In the above embodiment, the plurality of passage-forming holes 35, the plurality of first recessed portions 13, and the plurality of second recessed portions 23 are formed. However, the number of passage-forming holes 35, the number of first recessed portions 13, and the number of second recessed portions 23 are not limited. A single passage-forming hole 35, a single first recessed portion 13, and a single second recessed portion 23 may be formed.

The passage-forming holes 35, the first recessed portions 13, and the second recessed portions 23 may be spaced from each other at different distances.

The inner surface of each of the passage-forming holes 35 adjacent to the rotary shaft 17 may not be continuous with the outer peripheral surface of the outer wall portion 41*b*.

Each of the first recessed portions 13 may not face the one coil end 54*a* closer to the shaft support member 31 than the other coil end 54*a* in the radial direction of the rotary shaft 17.

The first recessed portion 13 may face the whole of the one coil end 54*a* closer to the shaft support member 31 than the other coil end 54*a* in the radial direction of the rotary shaft 17.

If the scroll type compressor 10 is configured to discharge the fluid compressed by the compression portion 15 from an outlet formed in the motor housing 11 into the motor chamber S1, the fluid passage, which is formed by the first recessed portion 13, the passage-forming hole 35, and the second recessed portion 23, serves as a discharge passage.

The first recessed portion 13 may be a through hole that is formed through the first flange 12 to allow the first end face 12*b* and the motor chamber S1 to communicate with each other.

The second recessed portion 23 may be a through hole that is formed through the second flange 22 to allow the second end face 22*b* and the compression chamber S2 to communicate with each other.

The compression portion 15 is not limited to a scroll type that includes the fixed scroll 41 and the movable scroll 42. The compression portion 15 may be a type such as a piston type or a vane type.

In the embodiment, each of the suction passages 25 includes the first recessed portion 13, the passage-forming hole 35, and the second recessed portion 23; however, the suction passage 25 (fluid passage) may include a hole formed in another member.

The first fastening hole and the second fastening hole may be formed without female thread, and a through bolt may be employed as the fastening member. In this case, the motor housing 11, the shaft support member 31, and the compressor housing 21 may be fastened by a nut and the through bolt, which is inserted through the first fastening hole, the through hole 33*a*, and the second fastening hole, to form the housing H.

What is claimed is:

1. An electric compressor comprising:

a housing;

a rotary shaft accommodated in the housing;

an electric motor accommodated in the housing and configured to rotate the rotary shaft;

a compression portion accommodated in the housing and configured for being driven by rotation of the rotary shaft to compress a fluid;

wherein the housing includes:

a motor housing having a bottomed cylindrical shape and accommodating the electric motor;

a compressor housing having a bottomed cylindrical shape and accommodating the compression portion; and a shaft support member interposed between and held by a first end face of an open end of the motor housing and a second end face of an open end of the compressor housing, the shaft support member cooperating with the motor housing to form a motor chamber that accommodates the electric motor and cooperating with the compressor housing to form a compression chamber that accommodates the compression portion, the shaft support member having an insertion hole through which the rotary shaft is inserted and rotatably supporting the rotary shaft; wherein the shaft support member, the motor housing, and the compressor housing being fastened with a fastening member to form the housing;

a fluid passage through which the motor chamber is in communication with the compression portion, wherein the first end face has a first fastening hole into which the fastening member is inserted and a first recessed portion formed in communication with the motor chamber, the second end face has a second fastening hole into which the fastening member is inserted and a second recessed portion formed in communication with the compression chamber, the shaft support member has a fitted surface fitted onto an opening of the motor housing and a flange portion extending from the fitted surface and interposed between and held by the first end face and the second end face, the flange portion has a through hole through which the fastening member is inserted and a passage-forming hole through which the first recessed portion and the second recessed portion are in communication with each other, wherein the passage-forming hole is formed outward of the fitted surface in a radial direction of the shaft support member, the through hole and the passage-forming hole are arranged in a circumferential direction of the flange portion, and the fluid passage is formed at least by the first recessed portion, the second recessed portion, and the passage-forming hole.

2. The electric compressor according to claim 1, wherein the electric motor includes a pair of coil ends, and the coil ends are respectively disposed on opposite sides of the electric motor in an axial direction of the rotary shaft, and at least a part of the first recessed portion faces, in a radial direction of the rotary shaft, one coil end of the coil ends that is closer to the shaft support member than the other coil end.

3. The electric compressor according to claim 1, wherein the compression portion includes a fixed scroll and a movable scroll that is configured to revolve with respect to the fixed scroll in conjunction with rotation of the rotary shaft, the fixed scroll includes a scroll wall and an outer wall portion surrounding the scroll wall, and the passage-forming hole has an elongated hole shape extending in the circumferential direction of the flange portion, and a part of an inner surface of the passage-forming hole adjacent to the fixed scroll is continuous with a part of an outer peripheral surface of the outer wall portion along the axial direction of the rotary shaft.

* * * * *